United States Patent [19]

Lindsay

[11] Patent Number: 4,851,707

[45] Date of Patent: Jul. 25, 1989

[54] "FRITTING" TECHNIQUE AND APPARATUS FOR IMPROVING THE SOUND OF SWITCHES AND CONNECTORS IN AUDIO CIRCUITS

[75] Inventor: David S. Lindsay, Sunnyvale, Calif.

[73] Assignee: Lindsay Audiophyle Associates, Sunnyvale, Calif.

[21] Appl. No.: 74,382

[22] Filed: Jul. 16, 1987

[51] Int. Cl.[4] ..... H01H 1/60

[52] U.S. Cl. ..... 307/137; 307/134; 307/132 M

[58] Field of Search ..... 307/112, 125, 130, 131, 307/134, 135, 137, 139, 132 M; 361/1-13

[56] References Cited

U.S. PATENT DOCUMENTS

| | | | |
|---|---|---|---|
| 2,608,607 | 8/1952 | Wharton et al. | 361/8 |
| 3,092,739 | 6/1963 | Lode | 307/137 |
| 3,641,357 | 2/1972 | Gratzmuller | 361/11 X |
| 3,794,850 | 2/1974 | Hirose | 307/137 |
| 3,796,891 | 3/1974 | Kind et al. | 307/135 |
| 3,868,550 | 2/1975 | Knauer et al. | 361/4 |
| 4,005,340 | 1/1977 | Hartel | 307/135 X |
| 4,056,836 | 11/1977 | Knauer | 361/4 |
| 4,134,026 | 1/1979 | Sone et al. | 307/137 |
| 4,459,629 | 7/1984 | Titus | 307/134 X |
| 4,550,356 | 10/1985 | Takahashi | 361/13 X |

OTHER PUBLICATIONS

"Electrical Contacts-1963" published 9/64, University of Maine (20 pages).

*Primary Examiner*—Bernard Roskoski
*Assistant Examiner*—Paul Ip
*Attorney, Agent, or Firm*—Skjerven, Morrill, MacPherson, Franklin and Friel

[57] ABSTRACT

The present invention is capable of applying a voltage across the contacts of a switch or connector in an audio system, the voltage being of sufficient level to provide a sufficiently high current to break down an insulating layer which has built up in the contacts thereof, improving the sound quality of the system. The invention may be an independent unit or may be incorporated in the overall audio system as an integral part thereof.

11 Claims, 1 Drawing Sheet

"FRITTING" TECHNIQUE AND APPARATUS FOR IMPROVING THE SOUND OF SWITCHES AND CONNECTORS IN AUDIO CIRCUITS

BACKGROUND OF THE INVENTION

1. Field of the Invention

This invention relates to audio equipment, and more particularly, to a device for improving the sound quality thereof.

2. Background of the Invention

A typical audio equipment system includes numerous switches for selecting system functions, and also numerous connectors between components of the system. These switches and connectors rely on metal-to-metal contact to conduct operational currents of the system.

Within seconds, oxide layers which act as insulators form on any metal surfaces exposed to air. This oxide layer inevitably reduces the sound quality of the overall system by reducing or eliminating the metal-to-metal contact is absent, a nonlinear "tunnel diode" is formed.

A technique known as "fritting," involving the breakdown of an insulating film structure by providing a large current through the contacts on which the film structure exists, is disclosed in "Electrical Contacts—1963," published August 1964, University of Maine. While that paper discusses laboratory tests of a fritting technique, such a technique has not been applied to audio systems with the goal of providing high sound quality thereof. Furthermore, the fritting technique discussed in that and other references was in reference to high current flows in industrial power switching, not in low-level signal switching such as occurs in audio circuits.

SUMMARY OF THE INVENTION

The present invention overcomes the above-cited problems by providing an apparatus that is capable of applying a voltage across an audio system connector or switch which produces in that connector or switch a higher current. This current is passed therethrough for a short period of time in order to improve the sound quality of the connector or switch.

The present invention further overcomes the above-cited problems by being included as a circuit portion which is an integral part of a circuit of an audio system, the circuit portion being capable of applying a voltage across an audio system connector or switch which in turn provides a current through that conductor or switch which is substantially higher than the normal current flowing therethrough in the operation of the connector or switch as part of the audio system.

DESCRIPTION OF THE PREFERRED EMBODIMENTS

Figure 1:
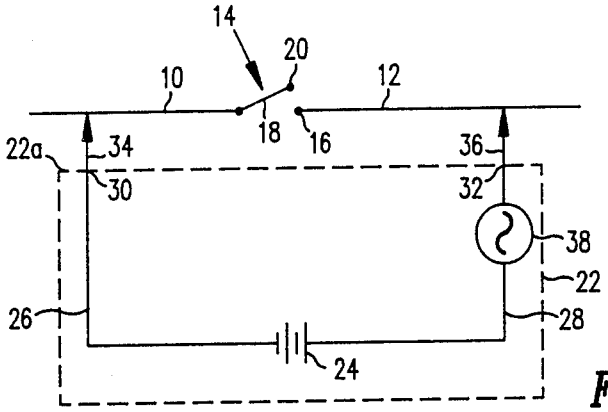
FIG. 1 shows a schematic view of an independent unit incorporating the invention.

Shown in FIG. 1 are conductive leads 10, 12 in an audio system which are connectable and disconnectable by means of an openable and closable switch 14. That is, the lead 12 includes a contact 16 at its end, and the switching element 18 of the switch 14 includes a contact

20 which may be brought into position adjacent the contact 16 of the lead 12 to provide conduction between the leads 10, 12. In normal use, this switch 14 may be any of the numerous switches in the audio system, such as any of the selector switches through which low-level signal current travels in the production of sound by the system.

The present device includes a case 22 enclosing batteries 24 which act as a voltage source. Conductive leads 26, 28 connect to the batteries 24 and extend to the surface 22a of the case 22. Jacks 30, 32 are provided at these points to receive the ends of respective clip leads 34, 36 whose other ends can appropriately be attached to the leads 10, 12 respectively.

An indicator light 38 is included in the lead 28.

In use, with the inclusion of the clip leads 34, 36 as described above, the clips thereof are attached to the leads 10, 12 and voltage from the batteries 24 is applied across the pair of contacts 16, 20 when they are adjacent each other, i.e. with the switch 14 closed, to provide current through the contacts 16, 20. This current is chosen to be substantially greater than the current carried through the contacts 16, 20 during their normal use in the audio system. In fact, it has been found advantageous to provide a current of at least 0.5 amperes through the contacts 16, 20, with the voltage determining this current being applied for at least 0.5 seconds.

This process acts to remove the insulating oxide layers as described above through the technique of fritting. This operation has been found to greatly increase the sound quality of a system in which an insulating oxide layer of any substance has been allowed to build up on the contacts.

The indicator light 38 indicates to the user that the voltage and current described above are indeed being applied across and through the contacts 16, 20.

Figure 1A:
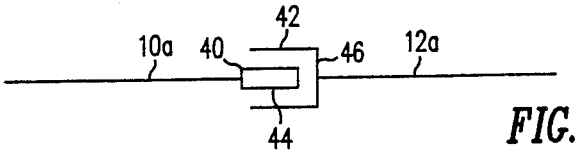
FIG. 1*a* shows a pair of conductive leads connected by male and female jacks.

FIG. 1*a*, instead of showing leads selectively connected by a switch, shows a pair of conductive leads 10*a*, 12*a* connected by male and female jacks 40, 42, which also include first and second respective contacts 44, 46 brought adjacent each other, and which may take the form of jacks for tuners, CD players, phonograph cartridges, turntables, tape recorders, preamps, power amps, etc., in an audio system. It will be readily seen that with the male and female members of an individual jack brought together, the device can be readily used therewithin the same manner as in the case where leads are connected by a switch.

Figure 2:
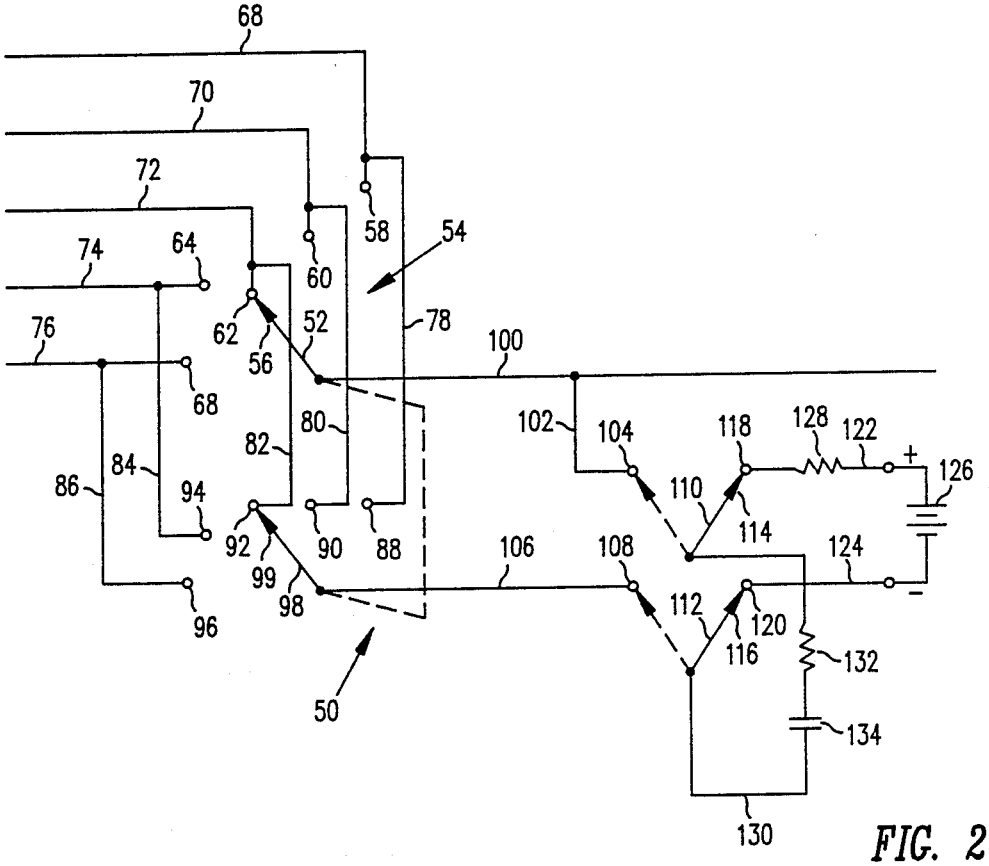
FIG. 2 is a schematic view of an audio circuit of which the inventive circuit portion is a part.

FIG. 2 shows an internal circuit 50 of an audio system which includes the present invention as an integral part thereof. As shown there in, the switching element 52 of a normal audio system switch 54 includes a contact 56 which may be brought adjacent any one of contacts 58, 60, 62, 64, 66 of respective conductive leads 68, 70, 72, 74, 76 by changing position of the switching element 52. This switch 54 may, for example, be used to select an audio input function in an audio system.

The leads 68–76 have respective conductive leads 78, 80, 82, 84, 86 connected thereto, each of which also has a respective contact 88, 90, 92, 94, 96. The switching element 52 is ganged with another switching element 98 to move therewith, this additional switching element 98 also having a contact 99 which may be brought into position adjacent one of the contacts 88–96 as the switching element 98 is moved to a chosen position.

An audio input conductive lead 100 connects to the switching element 52 as shown. The audio input lead 100 has connected thereto a conductive lead 102 including a contact 104, and the switching element 98 has connected thereto a conductive lead 106 including a contact 108. Switching elements 110, 112 are ganged for movement together, similar to the previously described switching elements, 52, 98, i.e., the switching elements 110, 112 include respective contacts 114, 116 which may be brought adjacent the respective contacts 104, 108. The switching elements 110, 112 may also be moved together to bring their contacts 114, 116 to adjacent respective contacts 118, 120 of conductive leads 122, 124, across which the voltage of a 12 volt power supply 126 is supplied. The lead 122 includes a resistor 128 as shown.

A conductive lead 130 connects the switching elements 110, 112, through a resistor 132 and a capacitor 134.

In the normal operation of the audio system, the switching elements 110, 112 are in the positions shown in full in FIG. 2, bringing the contact 114 of the switching element 110 adjacent the contact 118 of the lead 122, and bringing the contact 116 of the switching element 112 adjacent the contact 120 of the lead 124. Voltage from the power supply 126 is thereby applied to the capacitor 134 to in turn build up the voltage thereacross. The switching element 52 may be moved to any of its variety of positions to provide the audio output function chosen. During movement of the switching element 52, the switching element 98 moves therewith but this has no effect on the operation of the system, because as explained above the switching element contacts 114, 116 are removed from the contacts 104, 108 of the leads 102, 106.

With the switch 54, for example, in the position shown, with the contact 56 of switching element 52 adjacent the contact 62 of lead 72, and with the contact 99 of switching element 98 adjacent the contact 92 of lead 82, we will assume that it is now desirable to apply a voltage across the contact elements 56, 62 to in turn improve the sound quality of the audio system in that state determined by the position of the switching element 52. In such case, the switching elements 110, 112 are together moved to the positions shown in dotted lines in FIG. 2, so that the voltage built up on the capacitor 134 will be applied through the conductors 102, 106 across the contacts 56, 62 of the switch 54 which are brought adjacent each other. This occurs because of the ganged switching elements 52, 98 which move together as described above.

Again, the voltage applied across the contacts 56, 62 is applied for at least 0.5 seconds, and the current through the contacts 56, 62 is at least 0.5 amperes, which is substantially greater than the low-level signal current carried through those contacts 56, 62 during their normal use in the audio system.

When the fritting operation is to end, the switching elements 110, 112 are moved to their positions shown in full, bringing the respective contacts 114, 116 thereof adjacent the respective contacts 118, 120, allowing the capacitor 134 to again be charged.

If, for example, it is desired that a further fritting operation take place with the ocntact 56 of the switching element 52 brought adjacent the contact 64 of the lead 74, the movement of the switching element 52 to that position moves the switching element 98 to bring the contact 99 of the switching element 98 to adjacent the contact 94 of the lead 84, which connects to the lead 74. It will be seen that upon movement of the switching elements 110, 112 to the position shown in dotted lines, the voltage from the capacitor 134 will be applied across the adjacent contacts 56, 64, causing the fritting technique to be undertaken, thereby improving the sound quality of the system as determined by the switch 52 having its switching element contact 56 adjacent the contact 64 of the lead 74. Similar to the above, current is provided through the contacts 56, 64 of the switching element 52 and conductive lead 74 which is substantially greater than the low-level signal current carried through those contacts during their normal use in the audio system.

In this embodiment, the built-in nature of the circuit portion through which this is achieved provides ready and convenient use by the audio system user.

The 12 volt power supply may also power a portion of the preamplifier of the system.

While preferred embodiments of the present invention have been described in detail, it is to be understood that the invention is not limited to the embodiments disclosed, but is capable of numerous rearrangements and modifications and substitutions without departing from the spirit and scope thereof. Accordingly, it is intended that the scope of the present invention not be limited to the embodiments described above but be determined by a reference to the claims hereinafter provided.

I claim:

1. A method of improving the conductivity of a pair of adjacent contacts in an audio system comprising the steps of: manually connecting leads of a DC voltage source across said pair of adjacent contacts so that voltage from said DC voltage source across said adjacent contacts causes a current to flow through said adjacent contacts, said voltage source being external to and independent from said audio system; and maintaining said current supplied by said voltage source through said adjacent contacts at a level of at least 0.5 amperes and for a period of time to cause fritting of said contacts, thereby improving the conductivity of said adjacent contacts.

2. The method of claim 1 wherein said period of time is at least 0.5 seconds.

3. A circuit apparatus in an audio system comprising:

a first conductive lead;

a second conductive lead;

connector means connecting the first and second leads and comprising a pair of adjacent contacts; and means for selectively applying a voltage across the first and second conductive leads with the first and second conductive leads connected through the connector means to provide current through the contacts which is substantially greater than the current carried through the contacts during their normal use in the audio system, wherein said current is sufficient to cause fritting of said contacts.

4. The apparatus of claim 3 wherein the connector means comprise switch means for selectively connecting and disconnecting the first and second leads.

5. A circuit apparatus in an audio system comprising:

first, second and third conductive leads, the second and third conductive leads including respective contacts;

switch means comprising a switching element including a contact;

the switch means being switchable to a first position to bring the contact of the switching element to adjacent the contact of the second conductive lead, and to a second position to bring the contact of the switch means to adjacent the contact of the third conductive lead; and means for selectively applying a voltage across the first and second conductive leads only with the switching element in its first position, to provide current through the contacts of the switching element and second conductive lead which is substantially greater than the current carried through those contacts during their normal use in the audio system, and for selectively applying a voltage across the first and third conductive leads only with the switching element in its second position, to provide current through the contacts of the switching element and third conductive lead which is substantially greater than the current carried through those contacts during their normal use in the audio system, wherein said current is sufficient to cause fritting of said contacts.

6. The apparatus of claim 5 wherein the voltage is applied for at least 0.5 seconds.

7. The apparatus of claim 6 wherein a current of at least 0.5 amperes is provided through the various contacts.

8. The apparatus of claim 5 wherein the means for selectively applying voltage comprise a capacitor.

9. The apparatus of claim 8 wherein the voltage is applied for at least 0.5 seconds.

10. The apparatus of claim 3 wherein a current of at least 0.5 amperes is provided through the contacts.

11. The apparatus of claim 3 wherein the voltage is applied for at least 0.5 seconds.

* * * * *

UNITED STATES PATENT AND TRADEMARK OFFICE

CERTIFICATE OF CORRECTION

PATENT NO. : 4,851,707

DATED : July 25, 1989

INVENTOR(S) : David S. Lindsay

It is certified that error appears in the above-identified patent and that said Letters Patent is hereby corrected as shown below:

Col. 1, line 21, insert after "contact" --of the switch or connector. When metal-to-metal contact--.

Col. 3, line 62, "ocntact" should read --contact--.

Signed and Sealed this

Eleventh Day of September, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,851,707

DATED : July 25, 1989

INVENTOR(S) : David S. Lindsay

It is certified that error appears in the above-identified patent and that said Letters Patent is hereby corrected as shown below:

ON THE TITLE PAGE

Item [54], correct the title to read -- FRITTING TECHNIQUE AND APPARATUS FOR IMPROVING THE CONDUCTION OF SWITCHES IN AN AUDIO SYSTEM--.

Item [73], correct the Assignee to read --Lindsay-Geyer--.

Signed and Sealed this

Twenty-eighth Day of May, 1991

*Attest:*

HARRY F. MANBECK, JR.

*Attesting Officer*

*Commissioner of Patents and Trademarks*